US011231177B2

(12) United States Patent
Little et al.

(10) Patent No.: US 11,231,177 B2
(45) Date of Patent: Jan. 25, 2022

(54) FIREPLACE SYSTEM, HEAT EXCHANGER AND METHOD

(71) Applicant: FPI FIREPLACE PRODUCTS INTERNATIONAL LTD., Delta (CA)

(72) Inventors: Robert Little, Delta (CA); Julian Mills, Delta (CA)

(73) Assignee: FPI FIREPLACE PRODUCTS INTERNATIONAL LTD., Delta (CA)

( * ) Notice: Subject to any disclaimer, the term of this patent is extended or adjusted under 35 U.S.C. 154(b) by 201 days.

(21) Appl. No.: 16/392,241

(22) Filed: Apr. 23, 2019

(65) Prior Publication Data

US 2019/0316777 A1 Oct. 17, 2019

Related U.S. Application Data

(63) Continuation of application No. 15/411,426, filed on Jan. 20, 2017, now Pat. No. 10,309,656.

(60) Provisional application No. 62/281,033, filed on Jan. 20, 2016.

(51) Int. Cl.
*F24B 1/189* (2006.01)
*F24B 1/188* (2006.01)

(52) U.S. Cl.
CPC ..... *F24B 1/189* (2013.01); *F24B 1/1885* (2013.01)

(58) Field of Classification Search
CPC ..... F24B 1/189; F24B 1/1885
USPC ..... 126/523, 529, 79, 58, 77
See application file for complete search history.

(56) References Cited

U.S. PATENT DOCUMENTS

| | | | | |
|---|---|---|---|---|
| 4,096,849 | A * | 6/1978 | Moncrieff-Yeates | F24B 1/1885 126/529 |
| 4,194,487 | A * | 3/1980 | Cadwallader | F24B 1/16 126/61 |
| 4,230,092 | A * | 10/1980 | Henriques | F24B 1/18 126/527 |
| 4,510,918 | A * | 4/1985 | Ferguson | F23B 5/04 126/58 |
| 4,519,376 | A * | 5/1985 | Schoeff | F24B 1/1885 126/307 R |
| 4,766,876 | A * | 8/1988 | Henry | F24B 5/026 126/193 |
| 5,092,313 | A * | 3/1992 | Blackburn | F24C 3/006 126/512 |
| 6,019,099 | A * | 2/2000 | Shimek | F23J 11/02 126/11 OB |
| 2006/0112955 | A1* | 6/2006 | Reaves | F24B 1/1808 126/530 |
| 2008/0011286 | A1* | 1/2008 | Almasri | F24B 1/1808 126/502 |
| 2009/0151711 | A1* | 6/2009 | Wells | F24B 7/025 126/523 |
| 2014/0311477 | A1* | 10/2014 | Davenport | F24B 5/026 126/502 |

* cited by examiner

*Primary Examiner* — Avinash A Savani
(74) *Attorney, Agent, or Firm* — Snell & Wilmer LLP

(57) ABSTRACT

A fireplace system can comprise a firebox and a heat exchanger. The heat exchanger may be in fluid communication with ambient air and may comprise an inlet configured to draw air into the front of the heat exchanger. Operation of a fireplace system comprising a heat exchanger may produce airflow through the heat exchanger by natural convection. The airflow through the heat exchanger may reduce heat transmission from the firebox and the fireplace system.

15 Claims, 13 Drawing Sheets

200

FIREPLACE SYSTEM, HEAT EXCHANGER AND METHOD

CROSS-REFERENCE TO RELATED APPLICATION

This application is a continuation of, and claims priority to and the benefit of, U.S. application Ser. No. 15/411,426, filed on Jan. 20, 2017, entitled "FIREPLACE SYSTEM, HEAT EXCHANGER AND METHOD," which claims priority to and the benefit of U.S. Provisional Application No. 62/281,033, filed on Jan. 20, 2016 and entitled "FIREPLACE SYSTEM, HEAT EXCHANGER AND METHOD," both of which are incorporated by reference herein for all purposes.

FIELD

The present disclosure relates to fireplace systems. More particularly, the present disclosure relates to a fireplace system comprising a heat exchanger for maintaining a reduced operating temperature of a firebox and/or a fireplace cavity located above the firebox.

BACKGROUND

Available fireplace systems generally include one of a limited variety of mechanisms for distributing heat produced by operation of the firebox. These mechanisms most often consist of fan or blower-driven forced convection systems for exchanging air around a firebox, such as below and around the rear of a firebox. Such active, forced convection systems require integration of an electrical power source and fan or blower controls, adding to the cost and complexity of the fireplace system.

Other fireplace systems include passive heat dispersal systems that produce heat from the top of the firebox and transfer it to the external environment via vents located near the viewing area of the fireplace or elsewhere in a building structure defining a cavity above the fireplace. Some passive systems simply accumulate heat in a cavity above the fireplace, relying on cavity vents to release heat to the external environment. In some installations of fireplace systems with passive thermal transfer to the cavity above the fireplace, a vent-mounted fan may be used to reduce heat accumulation in the cavity. Some passive systems may draw air from around the firebox, such as from spaces behind and below the firebox that may communicate with an inlet beneath the fireplace opening. However, most passively cooled fireplace systems do not provide controlled convection systems and/or convective pathways suitable to provide consistently controlled fireplace system and cavity temperatures.

Thus, existing fireplace systems generally involve either electromechanical forced convection systems to distribute heat and maintain the fireplace system operating temperature, or they rely on passive cooling systems that can produce undesirable, substantially elevated temperatures in an enclosed cavity above the fireplace. Moreover, existing fireplace systems with active, forced convection heat distribution systems also typically include intakes and/or outlet vents located adjacent to or within the viewing area around the fireplace, and many existing passively cooled systems likewise include an intake and/or an outlet vent in the viewing area. These intake and outlet vents impinge on the aesthetic quality of the fireplace viewing area, cluttering it with visible functional components of the fireplace system that detract from a clean, streamlined fireplace appearance. Thus, fireplace systems with more efficient, low complexity, and aesthetically discrete systems for distributing heat from a firebox are desirable.

SUMMARY

In accordance with various aspects of the present disclosure, a fireplace system and heat exchanger and method are disclosed. In an exemplary embodiment, a fireplace system can comprise a firebox and a heat exchanger. The heat exchanger may be in fluid communication with ambient air and may comprise an inlet configured to draw air into the front of the heat exchanger. Operation of a fireplace system comprising a heat exchanger may produce airflow through the heat exchanger by natural convection. The airflow through the heat exchanger may reduce heat transmission from the firebox and the fireplace system.

In accordance with exemplary embodiment, a fireplace system may comprise a firebox enclosing a combustion chamber, and a heat exchanger. The heat exchanger may comprise an enclosure defining a heat exchanger air volume, a heat exchanger inlet disposed in the enclosure and in fluid communication with an external air source and the heat exchanger air volume, a heat exchanger outlet disposed in the enclosure and in fluid communication with the heat exchanger air volume, a cowl disposed about the heat exchanger inlet; and a firebox exhaust channel disposed through the enclosure and in fluid communication with the firebox.

BRIEF DESCRIPTION OF THE DRAWINGS

The exemplary embodiments of the present disclosure will be described in conjunction with the appended drawing figures in which like numerals denote like elements and.

DETAILED DESCRIPTION

Figure 1:
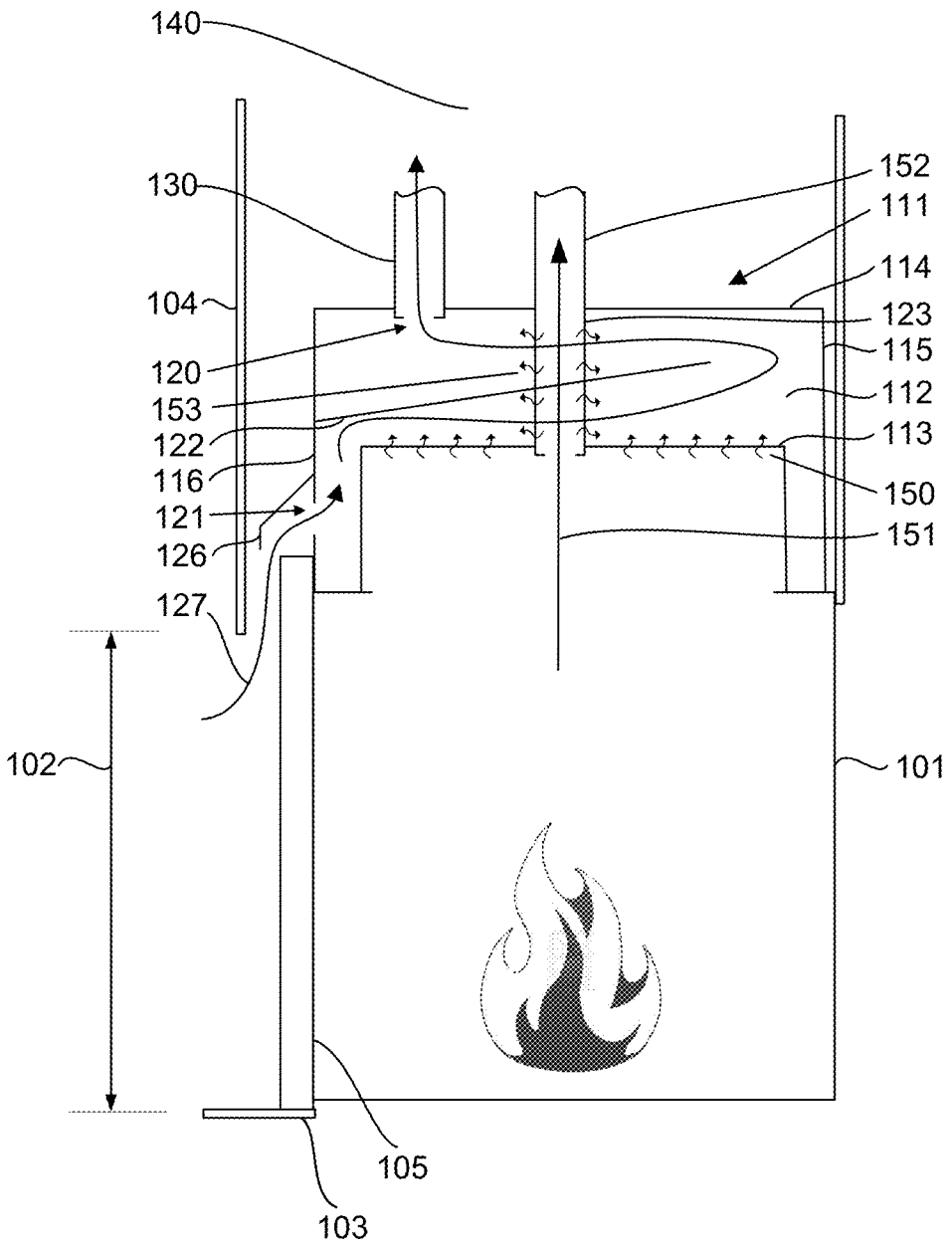
FIG. 1 illustrates a side view block diagram of a fireplace system and heat exchanger in accordance with various embodiments of the present disclosure.

The systems of the present disclosure may be described herein in terms of various functional components. It should be appreciated that such functional components may be realized by any number of hardware components configured to perform the specified functions. In addition, the present disclosure may be practiced in any number of firebox and/or fireplace system contexts and the systems and methods described herein are merely exemplary embodiments of the disclosure. Further, it should be noted that any number of fireplace system heat exchanger configurations may be adapted to achieve the various functions and benefits described herein, and such general techniques that may be known to those skilled in the art are not described in detail herein.

As used herein, the term "convective heat transfer" refers to the transfer of thermal energy by mass fluid flow, such as bulk airflow. As used herein, convective heat transfer includes the processes of advection as well as diffusion. The phenomenon of convective heat transfer may also be referred to simply as "convection" herein. "Natural convection" refers to convection that occurs as a result of relative density (i.e., relative buoyancy) changes between two portions of a fluid that are in fluid communication, thereby producing mass fluid flow. As used herein, natural convection includes convection produced by application of thermal energy to a volume of a fluid such as air. For example, natural convection may be produced by application of heat to a heat exchanger air volume, with the thermal energy input producing a decrease in the density of the air, thereby increasing the buoyancy of the air relative to a second volume of air, such as ambient air in fluid communication with the heat exchanger air volume. This may produce bulk airflow of the heated air if it is vented into an ambient air space. In contrast, for purposes of the present disclosure, the term "forced convection" refers to mass fluid flow produced by an external mechanical force, such as by operation of a fan or a blower.

As used herein, the term "aesthetically discrete" from a fireplace viewing area means inconspicuous or invisible to a casual viewer of the fireplace viewing area in the ordinary course (i.e., without close inspection), or visually distinct from the fireplace viewing area if visible (e.g., located in an area of the room at a distance away from and not immediately associated with the fireplace.

As used herein, the term "fireplace viewing area" means the visible portion of a fireplace system, particularly the portion of the fireplace system through which the interior of a firebox and/or a fire feature within the firebox are visible, such as a fireplace opening and the portion of the fireplace system framing and/or defining the fireplace opening. A "fireplace viewing area" can include a screen or safety barrier disposed across or in front of the fireplace opening. As mentioned above, a "fireplace viewing area" can also include a visible portion of a fireplace system framing the fireplace opening, as well as other features of a fireplace that may be separate from the functional fireplace system but contribute to the overall appearance of a fireplace, such as an adjacent surround, legs, jambs, or pilasters, a base, or a lintel, to name several.

In accordance with various embodiments of the present disclosure and as described in greater detail below, a fireplace system and method can provide for operational safety and distribution of heat from a fireplace system relying on natural convection and/or using inconspicuous natural convection cooling system inlets and outlets. A fireplace system can comprise a heat exchanger enclosing a heat exchanger air volume. The heat exchanger air volume may be in fluid communication with an external air source via a heat exchanger inlet. A fireplace system can optionally comprise a dual safety barrier defining an interbarrier space, and the heat exchanger air volume and heat exchanger inlet may be in fluid communication with an external air source via the interbarrier space. The heat exchanger can also comprise an outlet. A duct may be operatively coupled to the heat exchanger and in fluid communication with the heat exchanger air volume.

A fireplace system in accordance with various embodiments may be configured to provide for natural convection-based heat distribution and cooling of the firebox during operation of the fireplace system without a need for an electromechanical, forced convection air management component. However, a fireplace system in accordance with various embodiments of the present disclosure may also comprise a forced convection system component such as a fan or blower in addition to the various features of the fireplace systems disclosed herein, and nothing in the present disclosure should be interpreted to prohibit inclusion of such a component in a fireplace system. The airflow path of a fireplace system in accordance with various embodiments may comprise air drawn into the system from in front of and/or near the top-front area of the firebox opening and fireplace viewing area and vented upward from above the fireplace system, thereby providing an improved airflow path that is shorter than other existing systems with airflow paths that begin near the lower front portion of the fireplace and pass below and behind the firebox. The improved airflow path described in detail with respect to the various embodiments disclosed herein may facilitate the controlled, natural convective cooling achieved by the fireplace systems of the present disclosure without the need for electromechanical assistance while also providing a clean aesthetic appearance by eliminating the need for an air intake located below the firebox opening.

Referring now to FIG. 1, a schematic diagram of a fireplace system 100 in accordance with various embodiments is illustrated. Fireplace system 100 can comprise a firebox 101. The fireplace system and/or other features of a fireplace installation separate from the fireplace system itself may further define a fireplace opening 102 comprising the viewable area of fireplace system 100. For example, fireplace opening 102 may be defined in part by lower fireplace surround 103 and the front portion of fireplace cavity enclosure 104. Fireplace opening 102 defined by the fireplace system may provide visibility of the interior of the firebox and a fire feature and/or flame therein when fireplace system 100 is in operation. Fireplace system 100 may further include a safety barrier 105 disposed across fireplace opening 102 and/or the opening of firebox 101.

Firebox 101 and fireplace opening 102 can have any of a number of configurations in accordance with various embodiments. The diagram of fireplace system 100 illustrated in FIG. 1 is shown with a fireplace opening 102 on a single side of firebox 101 for simplicity. However, a fireplace system and firebox may have openings on one, two, three, four, or more sides in accordance with various embodiments of the systems and methods disclosed herein. A fireplace system in accordance with various embodiments can have any of a variety of fireplace opening configurations that are known in the art. Moreover, a fireplace opening can be defined by the firebox shell and/or various other components of a fireplace system such as one or more fireplace surround components (described in greater detail below).

In various embodiments, fireplace system 100 can comprise a heat exchanger such as heat exchanger 111. Heat exchanger 111 can comprise an enclosure configured to enclose a heat exchanger air volume 112. In various embodiments and as described in greater detail below, heat exchanger 111 may be disposed above the firebox 101 and configured to receive thermal energy 150 from the firebox during operation of the fireplace system. Heat exchanger 111 may comprise a lower wall 113, an upper wall 114, a rear wall 115, a front wall 116, and a pair of side walls (not shown). Heat exchanger 111 can further comprise an outlet 120, an inlet 121, a baffle 122, and a combustion exhaust gas channel 123. The various features of heat exchanger 111 are described in greater detail below.

In various embodiments, heat exchanger 111 can be a separate component from the firebox that may be modularly attached to firebox 101, or heat exchanger 111 may comprise an integral portion of a firebox or firebox shell (i.e., a portion of heat exchanger 111 may comprise an integrated component of a firebox, such as by a shared shell or wall panel). For example, all or a portion of one or more lower walls of a heat exchanger can also comprise an upper wall of a firebox. As illustrated in the schematic diagram of fireplace system 100 shown in FIG. 1, lower wall 113 of heat exchanger 111 comprises a portion of the upper wall of firebox 101. A heat exchanger in accordance with various embodiments can have a non-planar or multiplanar lower wall configuration, such as a lower wall 113 comprising a polyhedral-like surface that is concave relative to the combustion chamber. A lower wall configuration such as the concave, polyhedral-like surface in this embodiment may serve to increase the surface area of the heat exchanger enclosure shared with the firebox, thereby providing for increased thermal energy transfer from the firebox to the heat exchanger. However, any of a variety of possible heat exchanger shapes or configurations can be used in a fireplace system in accordance with various embodiments of the present disclosure.

Additionally, heat exchanger 111 may be configured such that the heat exchanger air volume 112 is not in fluid communication with the combustion chamber of firebox 101. A heat exchanger 111 can comprise a firebox exhaust channel 123 disposed through the heat exchanger and configured to permit combustion exhaust gases 151 to be transmitted through the heat exchanger 111 to an exhaust outlet 152 such as a chimney flue, direct vent, or other exhaust path. Firebox exhaust channel 123 may be configured so that heat exchanger air volume 112 is not in fluid communication with combustion exhaust gases 151 transmitted through heat exchanger 111. Exhaust outlet 152 can be coupled to firebox exhaust channel 123 to provide a secure combustion gas exhaust pathway out of the fireplace system. In various embodiments, firebox exhaust channel 123 through heat exchanger 111 can further provide additional transfer of thermal energy 153 to the heat exchanger and the heat exchanger air volume 112 in the heat exchanger via the walls of the channel. However, in various embodiments, a firebox exhaust channel need not be routed through the heat exchanger of a fireplace system and instead may be directly vented from firebox 101, such as through the rear of the fireplace system or via another pathway unassociated with the heat exchanger. Moreover, a firebox exhaust channel such as channel 123 can be configured to be coupled to a firebox exhaust system. A firebox exhaust system can comprise an exhaust flue suitable to provide fluid communication between exhaust channel 123 and the exhaust flue while also providing a separate, coaxial combustion air inlet channel for countercurrent flow of air into the firebox for combustion, such as via combustion air inlet channel 590 of fireplace system 500 (see FIG. 5A). A heat exchanger may be configured with any of a number of possible firebox exhaust channel configurations known to a person of ordinary skill in the art.

In accordance with various embodiments, an upper wall of the shell of firebox 101 and/or lower wall 113 of heat exchanger 111 can be constructed from materials suitable to provide effective thermal energy transfer from the firebox 101 to heat exchanger 111 during operation of the fireplace system. For example, various metals or metal alloys such as copper, aluminum, steel, or iron may be selected based on thermal conduction properties to provide efficient transmission of thermal energy 150 from the firebox 101 to heat exchanger 111 and heat exchanger air volume 112.

Similarly, a heat exchanger can be configured with features or components suitable to enhance thermal energy transfer to the heat exchanger and the air within the heat exchanger. For example and as illustrated, heat exchanger 111 can comprise baffle 122 configured to direct airflow from inlet 121 in a first airflow direction through a first portion of the heat exchanger air volume adjacent to the lower wall, with the airflow passing over the lower surface of the heat exchanger to a location distant from the heat exchanger inlet. Airflow passing the baffle may continue to a second portion of the heat exchanger, changing or reversing airflow directions to move in a second airflow direction toward heat exchanger outlet 120. A feature such as baffle 122 can thereby increase the airflow path length within heat exchanger 111 from heat exchanger inlet 121 to heat exchanger outlet 120, facilitating a greater transfer of thermal energy from firebox 101 and heat exchanger 111 to heat exchanger air volume 112. Any of a variety of other heat exchanger features or configurations may be used to achieve similar benefits, such as configurations that provide for an increased surface area and/or turbulent airflow within a heat exchanger, such as through the use of curves, corrugations, surface textures, fins, and the like, including features now known to or hereinafter devised by a person of skill in the art may be included within the scope of the present disclosure.

Heat exchanger 111 can further comprise an outlet 120. Outlet 120 can comprise an opening defined in a wall of heat exchanger 111 configured to vent heat exchanger air volume 112 from the heat exchanger. For example, outlet 120 may be located in upper wall 114 of heat exchanger 111 and be configured to vent buoyant air from the heat exchanger. Heat exchanger air volume 112 may become buoyant relative to ambient air during operation of fireplace system 100 due to transfer of thermal energy (e.g., thermal energy 150 from firebox 101 and thermal energy 153 from firebox exhaust channel 123) from the firebox to heat exchanger 111. In various embodiments and as described below, venting heat exchanger air volume 112 after it has become buoyant due to transfer of thermal energy from firebox 101 to heat exchanger 111 can produce bulk airflow through the heat exchanger.

In various embodiments, fireplace system 100 may further comprise an outlet duct 130. Outlet duct 130 may be operatively coupled to heat exchanger 111 at outlet 120. Outlet duct 130 can comprise a modular component of fireplace system 100 that can be removably coupled at a proximal end to heat exchanger 111 at the location of heat exchanger outlet 120, for example, using an adapter plate, collar, flange, or similar mechanism for coupling a duct to an outlet. Outlet duct 130 can be adjustably configured to locate a distal end of the outlet duct at an external location, such as a vent or register, at a location that is remote from the fireplace viewing area, as described in more detail below. Thus, heat exchanger outlet 120 and outlet duct 130 may define a secure outlet pathway suitable to provide fluid communication between the heat exchanger air volume 112 in heat exchanger 111 and an external location.

Figure 3:
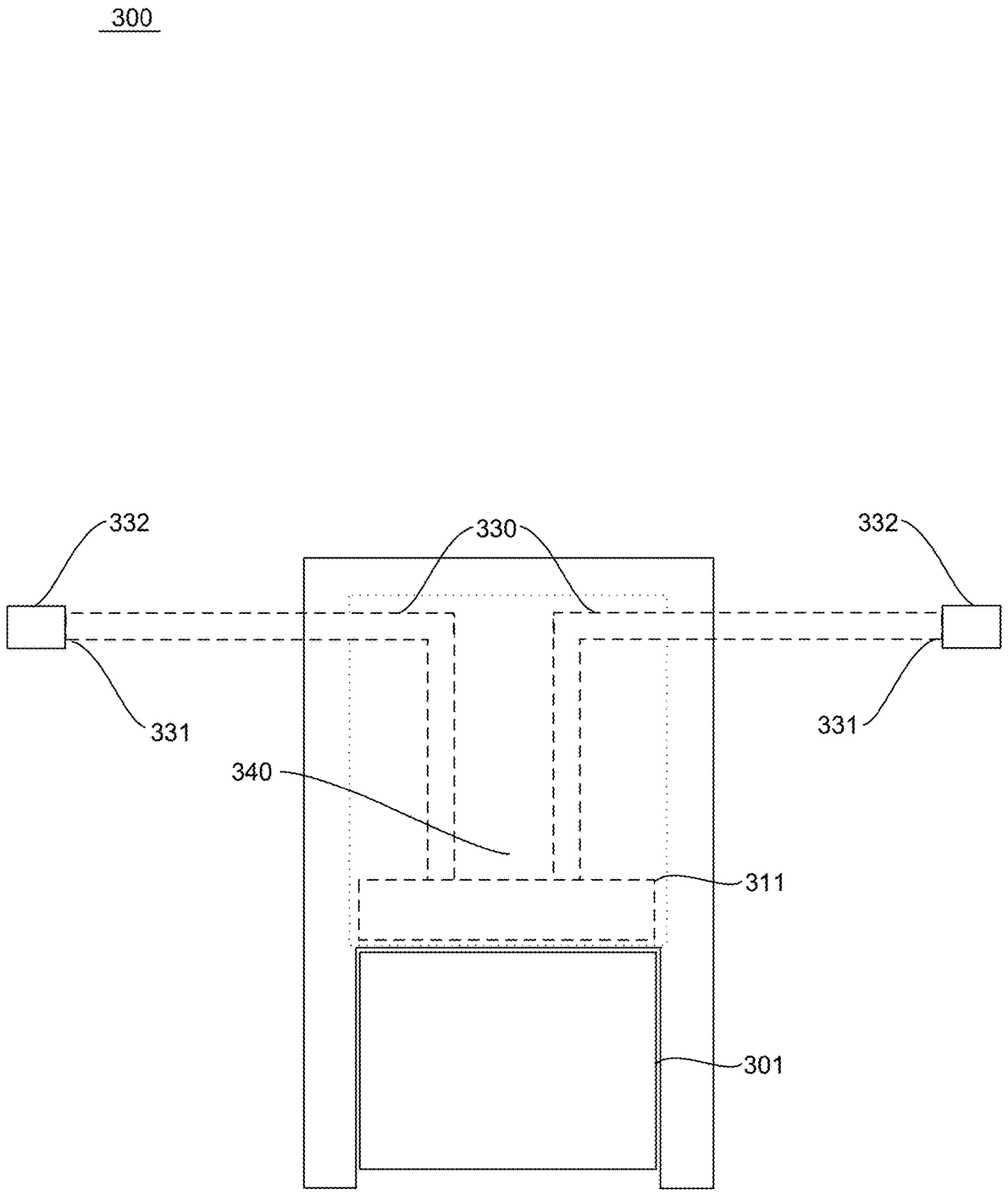
FIG. 3 illustrates a front view block diagram of a fireplace system and heat exchanger in accordance with various embodiments of the present disclosure.

For example, and with reference briefly to FIG. 3, a distal end 331 of outlet duct 330 may be located at an external location 332. External location 332 may be at a position away from the viewing area of fireplace system 300, for example, outside of and lateral to the region enclosing cavity 340 above firebox 301. The length of outlet duct 330 can be varied in accordance with the requirements of a particular fireplace system installation. In various embodiments, a fireplace system can comprise a plurality of outlet ducts 330, with each outlet duct configured to vent to a different external location 332. As illustrated in FIG. 3, a fireplace system in accordance with various embodiments may be configured to direct air heated in heat exchanger 311 during operation of firebox 301 to an external location outside of cavity 340 and remote from the general location of firebox 301 and the viewing area of fireplace system 300. In this manner, a fireplace system in accordance with the present disclosure can distribute heat produced by operation of the fireplace system to distant parts of a room while providing for an enhanced aesthetic appearance of the fireplace opening due to the remote location of the distal ends of the outlet ducts.

Figure 2:
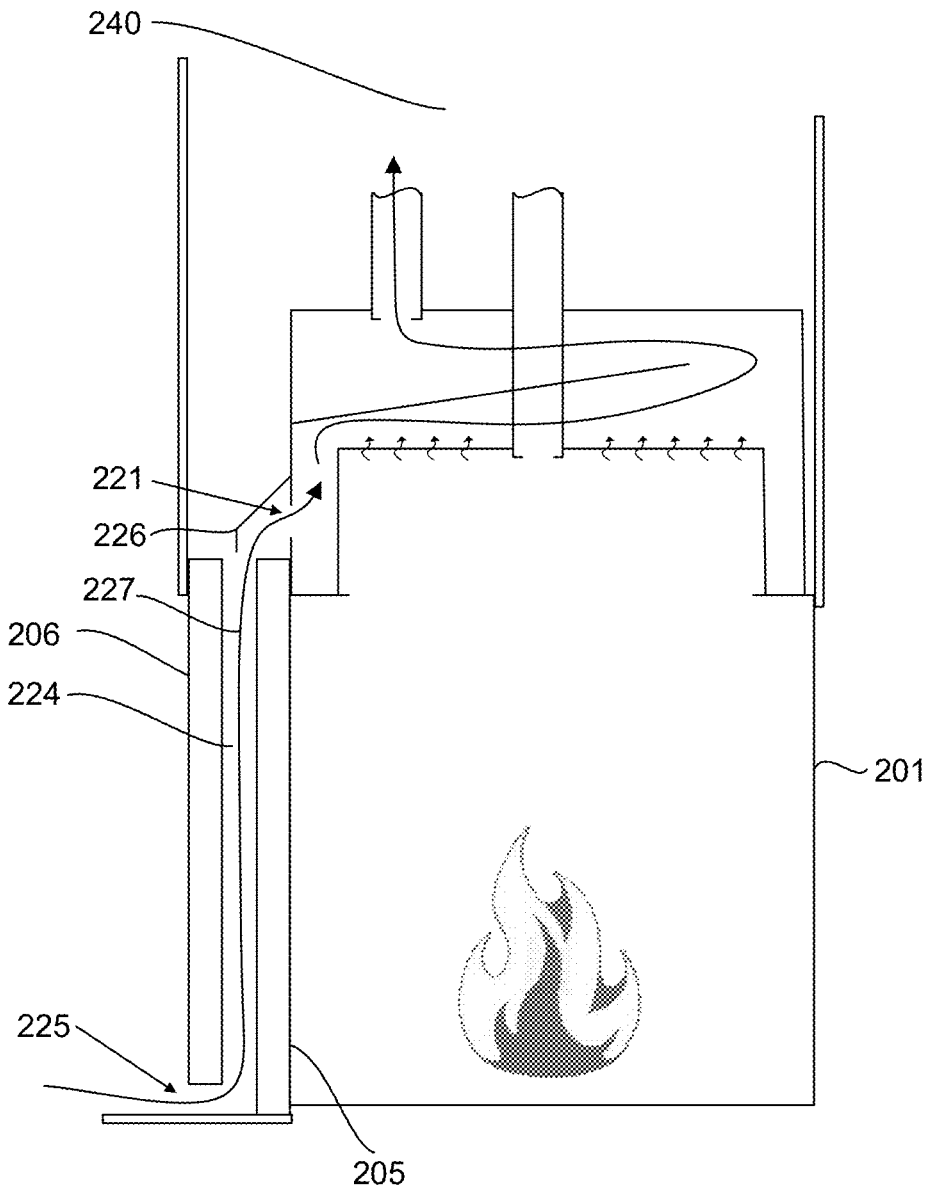
FIG. 2 illustrates a side view block diagram of a fireplace system and heat exchanger in accordance with various embodiments of the present disclosure.

In various embodiments and with reference again to FIG. 1, heat exchanger 111 can comprise heat exchanger inlet 121. Heat exchanger inlet 121 can comprise an opening in the heat exchanger enclosure, such as a slot or a pattern of openings disposed in one or more walls of heat exchanger 111. Heat exchanger inlet 121 may be configured to provide fluid communication between an external location and heat exchanger air volume 112, thereby permitting airflow into the heat exchanger. In various embodiments, the configuration of heat exchanger inlet 121 may be suitable to accommodate a desired airflow rate through heat exchanger 111 during operation of fireplace system 100. For example, the total area, location, and configuration (e.g., slot or grating pattern and orientation) may be designed to minimize resistance to airflow into the heat exchanger. Moreover, heat exchanger 111 and heat exchanger inlet 121 may be configured to receive airflow from an external air source via a direct or an indirect path. For example, heat exchanger inlet 121 may receive airflow directly from an external location such as the room in which the fireplace system is placed. In various embodiments and with reference briefly to FIG. 2, heat exchanger inlet 221 may be in fluid communication with an interbarrier space 224 between first protective barrier 205 and second protective barrier 206. Interbarrier space 224 in turn may be in fluid communication with an external, ambient air source such as the room air via an interbarrier space inlet 225. In these embodiments, the heat exchanger inlets are aesthetically discrete and within the viewing area of the fireplace, comprising a gap or space between an edge of a protective barrier and an adjacent structure defining the fireplace viewing area, With reference again to FIG. 1, heat exchanger 111 may further optionally comprise a cowl 126. Cowl 126 may be configured to direct airflow 127 from an external location into inlet 121. In various embodiments, cowl 126 may be configured to direct all or a portion of airflow 127 from into heat exchanger inlet 121. For example and as shown in FIG. 1, cowl 126 may be configured to permit a portion of the airflow from an external location to pass in front of cowl 126 and enter into cavity 140 above fireplace system 100.

Likewise and with reference again to FIG. 2, cowl 226 may be configured to direct a portion of airflow along airflow path 227 through interbarrier space inlet 225 and interbarrier space 224 into heat exchanger inlet 221, such as by being partially disposed in the interbarrier space outlet at an angle suitable to direct airflow into inlet 221. Stated differently, in various embodiments, fireplace system 200 can comprise a cowl 226 configured to direct airflow exiting interbarrier space 224 between a first airflow path 227 (such as into inlet 221) and a second airflow path (such as into cavity 240).

In various embodiments, a cowl such as cowl 126 (FIG. 1) may have a fixed position relative to the heat exchanger and/or other components of fireplace system 100, or a cowl may be adjustable. An adjustable cowl may be adjusted during assembly or installation of a fireplace system, for example, to accommodate various installation parameters that might vary by installation, such as a room configuration, cavity configuration, vent duct length and outlet location, and the like. In various embodiments, a cowl may be user- or operator-adjustable following installation of fireplace system 100. Moreover, a cowl need not be attached to heat exchanger 111, but instead may be attached to or supported by other components of a fireplace system. Any configuration of a cowl that may be conceived by a person of ordinary skill in the art may be used for a fireplace system in accordance with various embodiments of the present disclosure.

In accordance with various embodiments of a fireplace system, a cowl is not required. Instead, a fireplace system can comprise a manifold or other configuration or component to provide a secure airflow pathway into an inlet of a heat exchanger.

Figure 4:
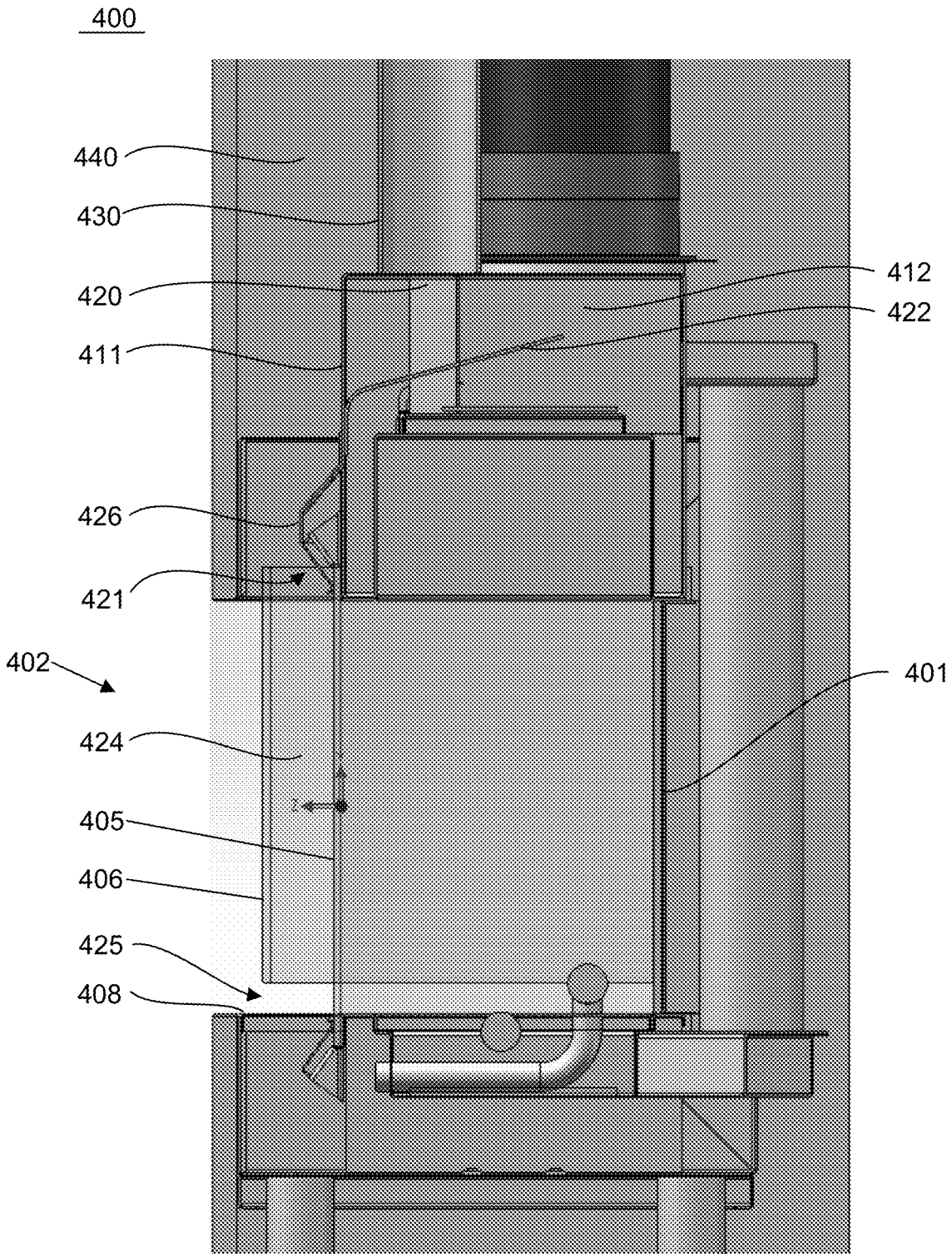
FIG. 4 illustrates a side cross-sectional view of a fireplace system and heat exchanger in accordance with various embodiments of the present disclosure.

FIG. 4 illustrates a side view of a fireplace system 400 in accordance with various embodiments of the present disclosure. Fireplace system 400 comprises many of the components of fireplace systems 100 and 200 illustrated and described with reference to the schematic diagrams shown in FIGS. 1 and 2. Fireplace system 400 comprises a firebox 401 defined in part by a firebox shell. Fireplace system 400 further defines a firebox opening 402 to permit visibility of the fire or fire feature. The firebox opening is enclosed by a first safety barrier 405, and a second safety barrier 406 is disposed in front of and spaced away from the first safety barrier. In various embodiments, first safety barrier 405 and second safety barrier 406 can comprise a glass pane, such as an approximately 5 mm thick tempered glass or ceramic glass pane. The spacing between the safety barriers defines an interbarrier offset distance, with the safety barriers partially enclosing interbarrier space 424. Fireplace system 400 may further comprise various fireplace system components beneath the lower portion of the shell of firebox 401. Such components can include, for example, structural support and/or legs for the fireplace system, combustion air supply channels, gas supply pipe, regulators, burner components, and the like. An aperture between a lower edge of second safety barrier 406 and lower fireplace surround 408 defines interbarrier space inlet 425 and permits fluid communication between ambient or room air outside of fireplace system 400, interbarrier space 424, and heat exchanger air volume 412.

In accordance with various embodiments, fireplace system 400 further defines an interbarrier space outlet at the upper end of interbarrier space 424. Interbarrier space outlet can provide fluid communication between interbarrier space 424 and other portions of fireplace system 400, such as heat exchanger 411 and cavity 440. Fireplace system 400 comprises cowl 426 located adjacent to the interbarrier space outlet and configured to direct airflow exiting from interbarrier space 424. As shown in FIG. 4, cowl 426 can be disposed in the outlet in a position suitable to permit a portion of the airflow into cavity 440, while a portion of the airflow may be directed into heat exchanger 411 via heat exchanger inlet 421. Heat exchanger 411 is configured to enclose heat exchanger air volume 412. In various embodiments, a heat exchanger can also comprise a baffle such as baffle 422 enclosed in the heat exchanger. Baffle 422 may be configured to direct incoming air within the heat exchanger in a manner suitable to maximize thermal energy transfer from the upper wall(s) of the firebox shell to the heat exchanger air volume 412, such as by directing incoming air in a first airflow direction over the lower surface(s) of the heat changer to maximize incoming air contact with and thermal energy transfer from the upper wall(s) of the heat exchanger to the incoming air and by minimizing dead zones having poor airflow within the heat exchanger. Airflow in heat exchanger 411 can continue around baffle 422 to the upper portion of heat exchanger 411, with the airflow changing to a second airflow direction from the rear wall of the heat exchanger toward outlet 420. Fireplace system 400 can further comprise outlet duct 430 in fluid communication with heat exchanger 411 via heat exchanger outlet 420. Outlet duct 430 may be configured to channel heated air to a remote outlet by natural convection forces produced by thermal energy transfer from the firebox to air in heat exchanger 411.

With reference to FIGS. 5A-5H, a fireplace system 500 is illustrated. Fireplace system 500 comprises many of the features of fireplace systems 100, 200, and 400 illustrated and described above with reference to the schematic diagrams shown in FIGS. 1, 2 and 4. Moreover, fireplace system 500 comprises various features described in more detail below and illustrated in the accompanying figures.

Figure 5A:
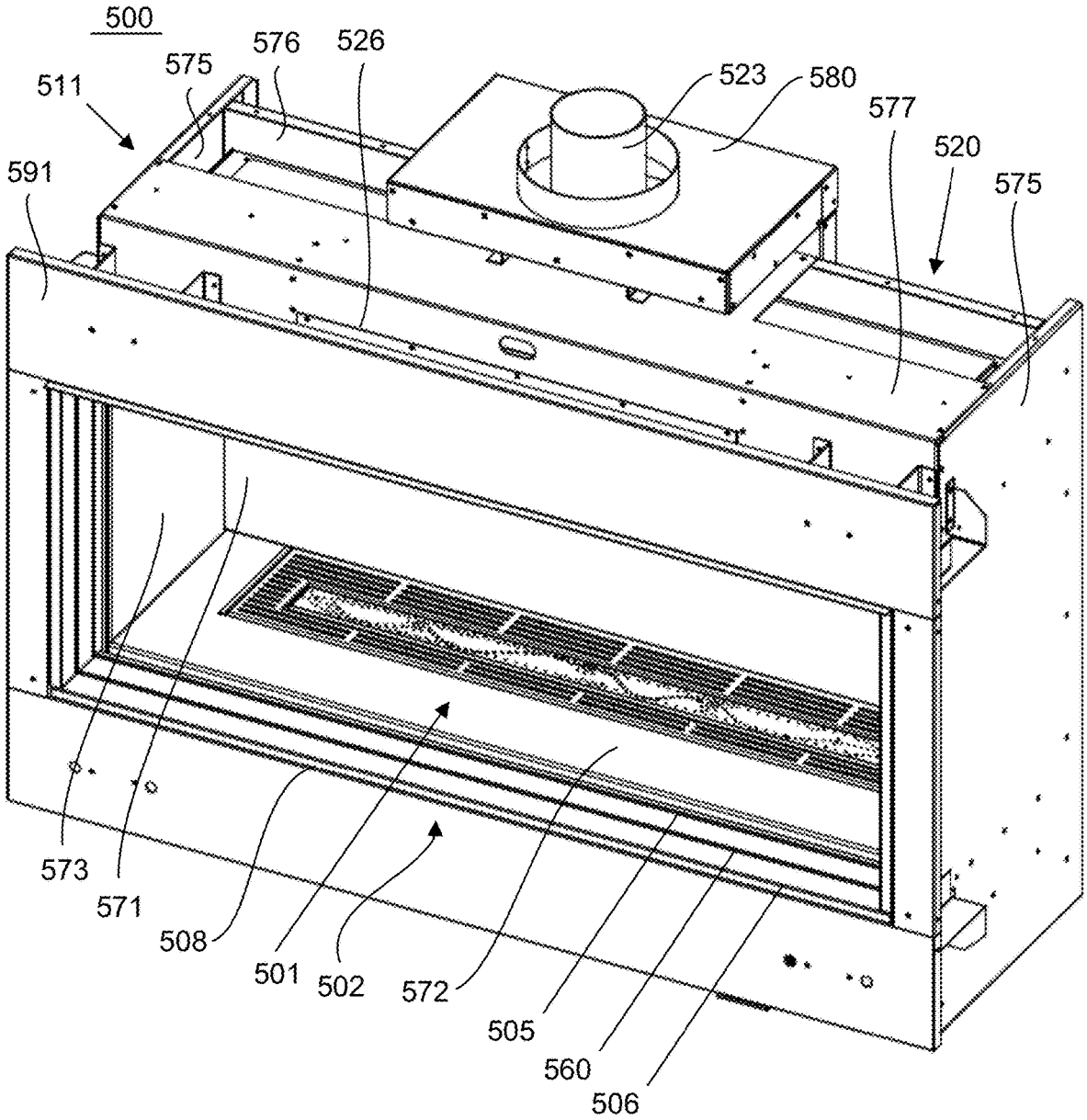
FIGS. 5A-5H illustrate views of a fireplace system and heat exchanger in accordance with various embodiments of the present disclosure.
Figure 5B:
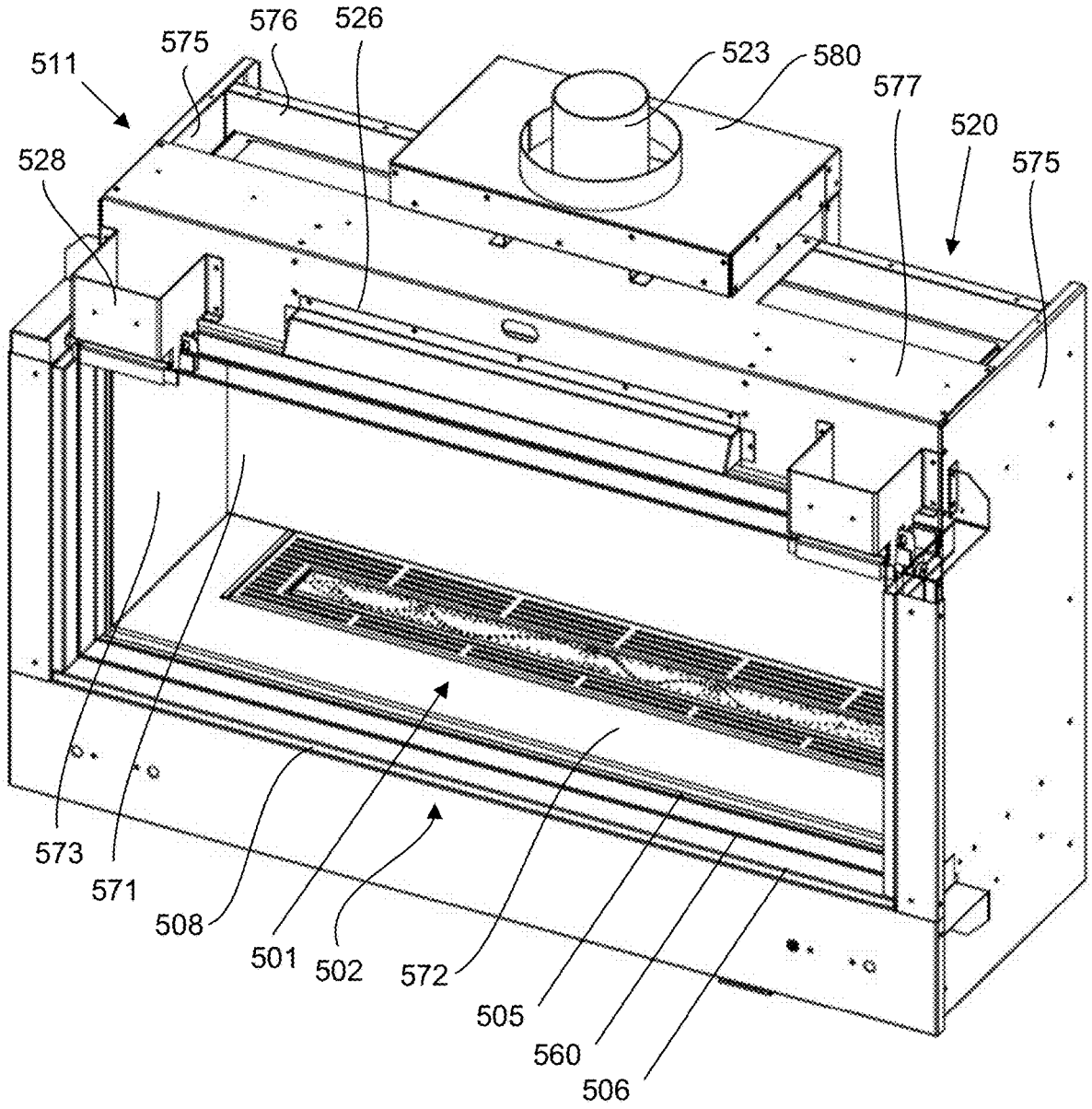
Figure 5C:
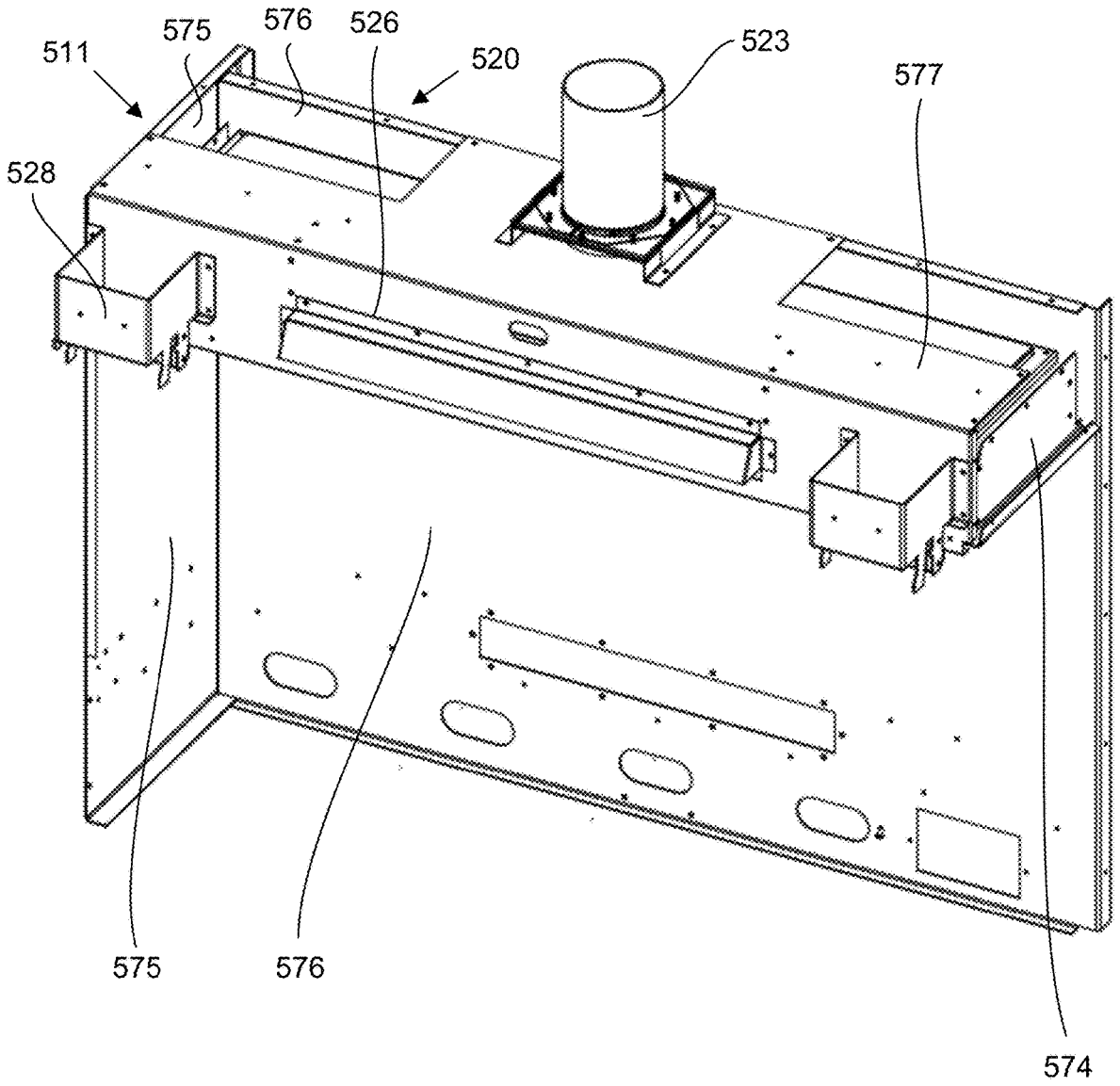
Figure 5D:
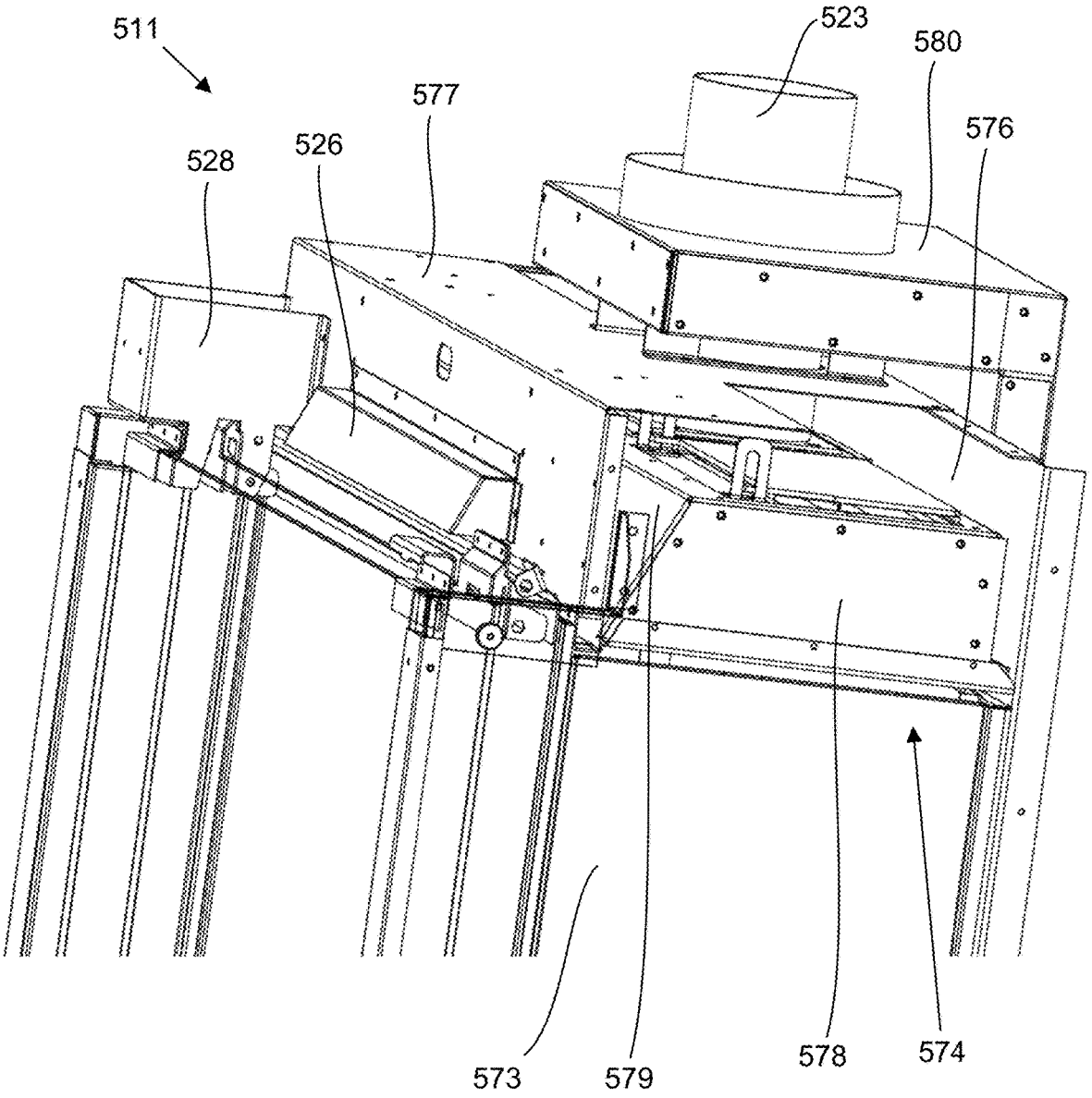
Figure 5E:
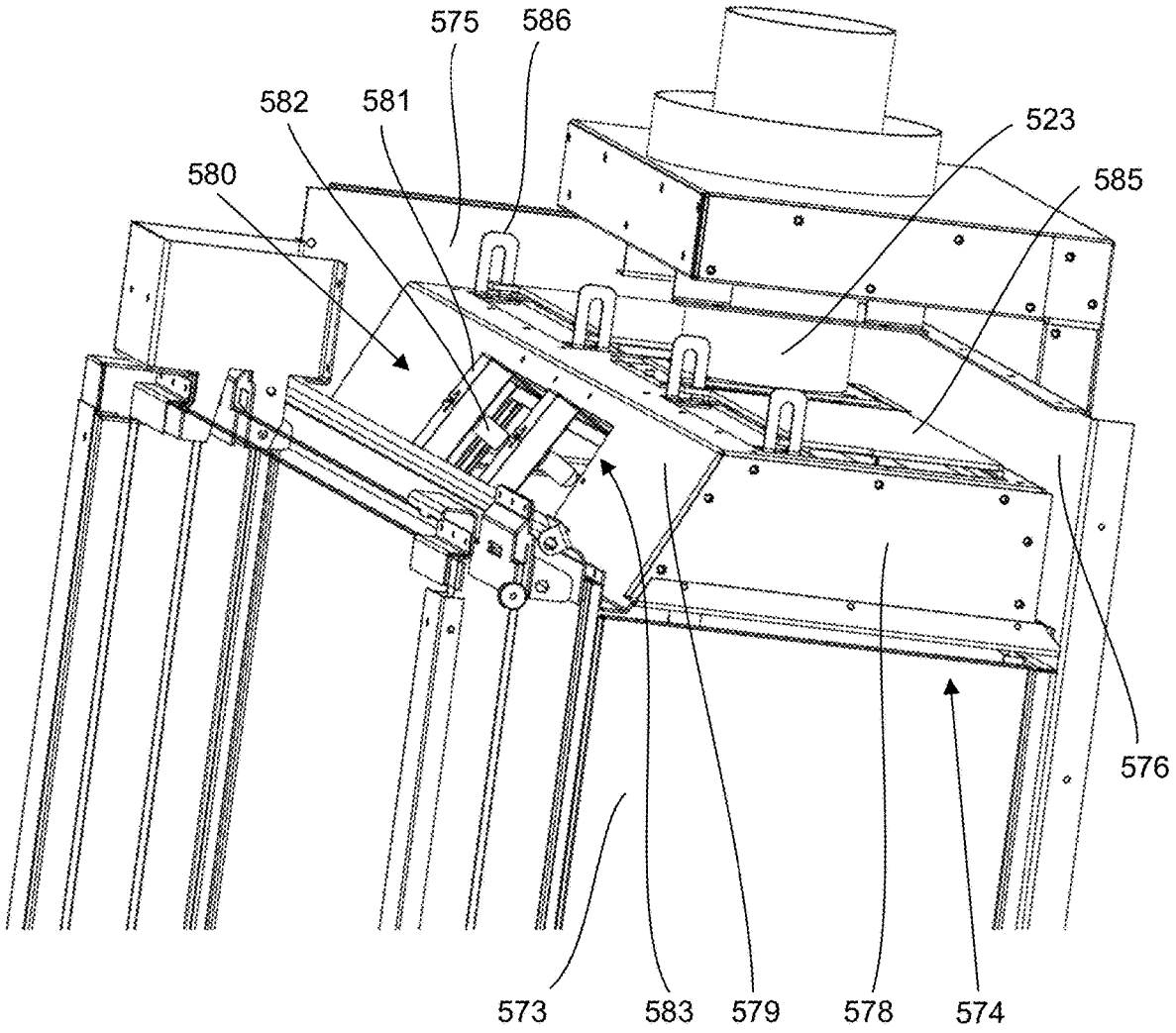
Figure 5F:
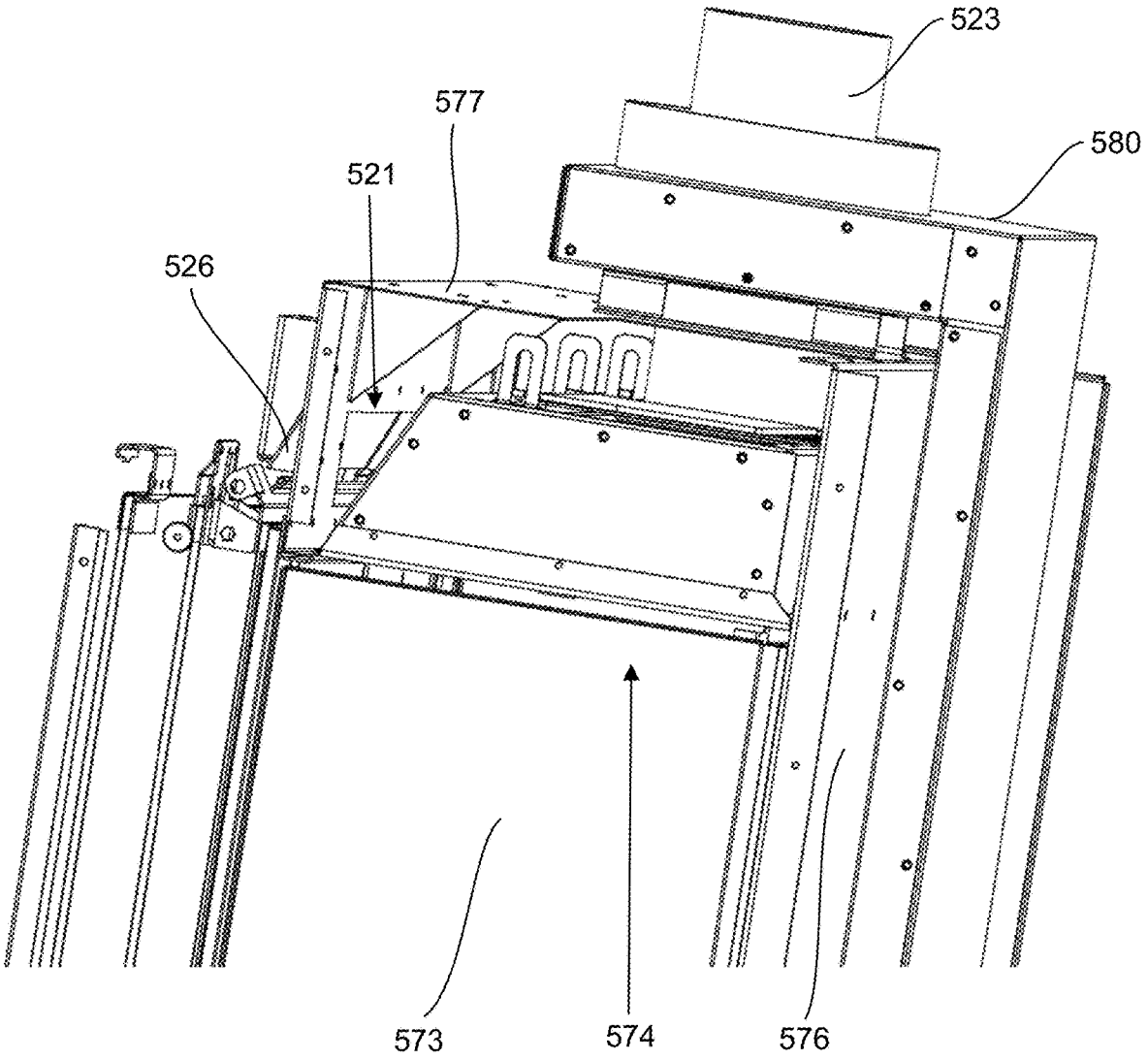
Figure 5G:
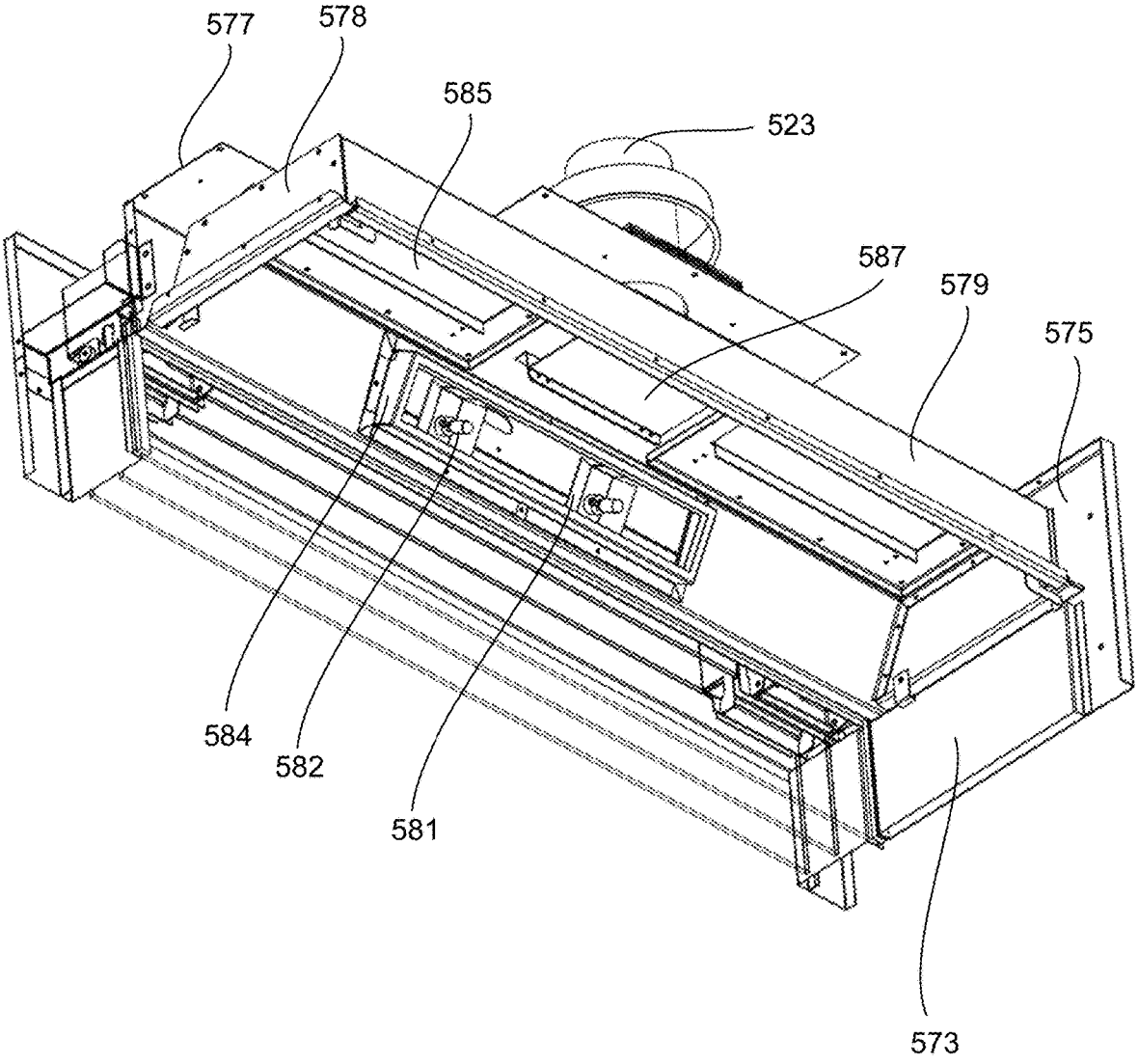

Referring now to FIG. 5A, fireplace system 500 comprises a firebox 501 with a combustion chamber enclosed in part by a firebox shell. A firebox shell can comprise a plurality of panels, such as rear panel 571, lower panel 572, and side panels 573. Fireplace system 500 further comprises heat exchanger 511 disposed above firebox 501. In various embodiments, a lower heat exchanger assembly 574 (see FIG. 5E) of heat exchanger 511 encloses the upper portion of the combustion chamber. Firebox 501 comprises a single firebox opening 502 with first safety barrier 505 disposed across firebox opening 502 and enclosing the combustion chamber together with the firebox shell. Fireplace system 500 further comprises second safety barrier 506 disposed in front of firebox opening 502 and first safety barrier 505, as well as third safety barrier 560 disposed in the interbarrier space between first safety barrier 505 and second safety barrier 506. FIG. 5B shows fireplace system 500 with front panel 591 removed to more clearly illustrate the relationships of first safety barrier 505, second safety barrier 506, and third safety barrier 560, as well as various features of heat exchanger 511, such as cowl 526 and safety barrier supports 528, described in more detail below. 408

Figure 5H:
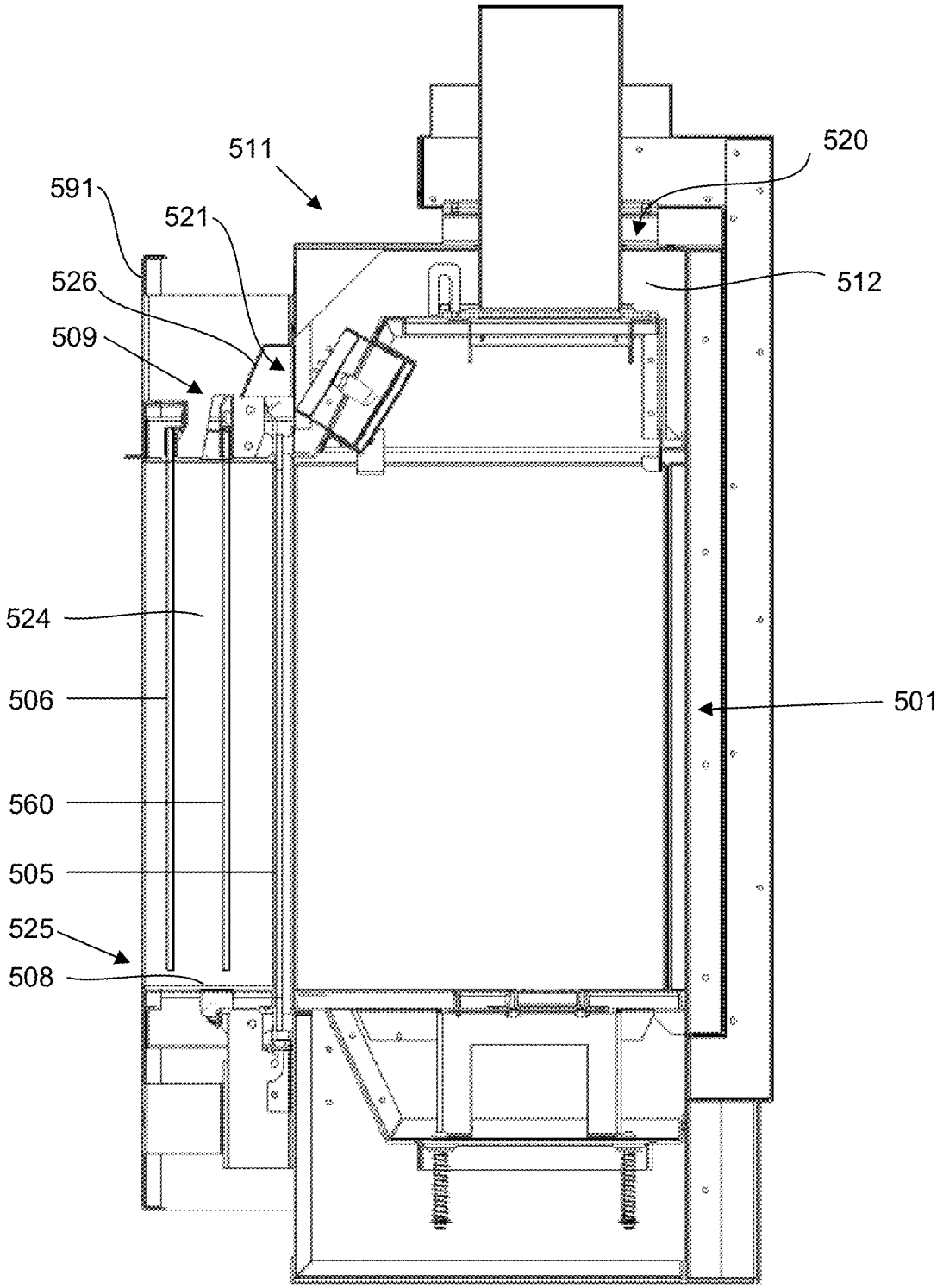

With reference now also to FIG. 5H illustrating a cross section of fireplace system 500, cowl 526 of heat exchanger 511 can be located adjacent to interbarrier space outlet 509 and configured to direct airflow exiting from interbarrier space 524 into heat exchanger 511. As shown in FIG. 5H, cowl 526 may be disposed in outlet 509 in a position suitable to permit a portion of the airflow past cowl 526, for example, into a cavity or enclosed chase above system 500, while a portion of the airflow is directed into heat exchanger 511 via heat exchanger inlet 521 (see also FIG. 5F). In various embodiments and as illustrated, cowl 526 need not extend the full length of the fireplace opening. Instead, cowl 526 may be centrally located in front of the hottest part of the firebox, for example, with a length and position corresponding approximately to that of a burner or fire feature. Moreover, a cowl may not extend to meet or contact the top of the second safety barrier or third safety barrier. Without wishing to be bound by theory, physical contact between the cowl and the safety barrier can cause undesirable results in safety barrier temperature tests, possibly due to conduction of thermal energy from the cowl to the safety barrier glass.

In various embodiments, a fireplace system can further comprise a plurality of outer panels housing the system. The outer panels can also partially enclose a heat exchanger of a fireplace system, thereby comprising a portion of the heat exchanger enclosure (i.e., walls of the heat exchanger enclosure). As mentioned above and with reference again to FIGS. 5A and 5B as well as FIGS. 5C-5E, lower heat exchanger assembly 574 defines the lower walls of the heat exchanger 511 enclosure. Heat exchanger 511 is further defined by outer side panels 575 (right outer side panel 575 is removed in FIG. 5C to show location of lower heat exchanger assembly 574) and outer rear panel 576. A heat exchanger enclosure may be completed by one or more front and/or upper panels that may be separate or unitary, such as upper heat exchanger panel 577, a unitary panel that comprises the upper and front walls of heat exchanger 511. The various panels comprising heat exchanger 511 may be attached to one another to define an enclosure configured to contain heat exchanger air volume 512. The upper heat exchanger panel may define one or more openings comprising heat exchanger outlets in fluid communication with heat exchanger air volume 512, such as outlets 520. Heat exchanger 511 includes two outlets 520 located toward the rear of the heat exchanger, away from cowl 526 and heat exchanger inlet In various embodiments, heat exchanger 511 can further provide structural support for other components of a fireplace system. For example, safety barrier supports 528 may be mounted to the front wall of upper heat exchanger panel 577. The upper wall of upper heat exchanger panel 577 can also be configured to provide support for brackets used to secure exhaust channel 523 or combustion air inlet channel 590. Brackets used to secure combustion air inlet channel 590 can be configured to provide a space between upper heat exchanger panel 577 and combustion air inlet channel 590 to reduce thermal energy transfer from heat exchanger 511 to combustion air inlet channel 590.

In various embodiments, a lower heat exchanger assembly can comprise a variety of components. With reference to FIGS. 5D-5G, lower heat exchanger assembly 574 comprises a polyhedral-like surface that is essentially concave with respect to the combustion chamber, with side walls 578 attached to lower wall 579. Lower wall 579 comprises a unitarily constructed, multiplane panel with a front plane, a bottom plane, and a rear plane. However, in various embodiments, a lower wall can comprise separate panels joined to one another and to side walls 578 to form the surfaces of a lower heat exchanger assembly. Lower heat exchanger assembly 574 can further comprise a firebox light assembly, such as light assembly 580 (see FIG. 5E, with upper heat exchanger panel 577 and cowl 526 removed to show detail) disposed in the front plane of lower wall 579. Light assembly 580 comprises brackets 581 configured to receive a light source 582 and to position the light source to illuminate the interior of the firebox through a light assembly aperture 583 in the front plane of lower wall 579. A glass barrier may be disposed across the aperture to enclose the firebox and prevent communication of combustion exhaust through light assembly aperture 583 and into heat exchanger 511. The glass barrier of light assembly 580 may be secured to upper heat exchanger panel 577 by inner light assembly bracket 584 and can comprise a glass material suitable to withstand the temperatures of the combustion chamber, such as ceramic glass.

Lower heat exchanger assembly 574 can further comprise a pressure relief mechanism such as pressure relief doors 585 configured to enclose apertures in the bottom plane of lower wall 579. Pressure relief doors 585 may be operatively attached to lower wall 579, such as by gravity or a friction fit, and be secured to lower wall 579 by pressure relief door brackets 586. Pressure relief doors 585 may be configured to open in the event of an explosive build-up of pressure in the combustion chamber of firebox 501 and relieve pressure through the apertures in lower wall 579 enclosed by the pressure relief doors. Lower heat exchanger assembly 574 can further include exhaust channel baffle 587 (FIG. 5G) disposed in front of an aperture in lower wall 579 in fluid communication with exhaust channel 523. Exhaust channel baffle 587 may facilitate distribution of thermal energy from the combustion chamber to the surfaces of the lower heat exchanger assembly by reducing heat loss directly up exhaust channel 523. However, a fireplace system in accordance with various embodiments need not comprise an exhaust channel baffle, and exclusion of an exhaust channel baffle can facilitate achieving lower operating temperatures for an otherwise identically configured fireplace system.

With reference now also to FIG. 5H, as described above, heat exchanger 511 is configured to enclose heat exchanger air volume 512. During operation of fireplace system 500, airflow entering heat exchanger 511, such as airflow through the air path from interbarrier space inlet 525 (defined by second safety barrier 506 and lower fireplace surround 508), interbarrier space 524, interbarrier space outlet 509, cowl 526 and heat exchanger inlet 521, can pass through the heat exchanger and exit the heat exchanger through heat exchanger outlets 520. As described above, heat exchanger outlets 520 may be located toward the rear of the heat exchanger and away from the portion of the heat exchanger that experiences the highest temperatures during fireplace operation, such as a central area of the heat exchanger, to maximize contact of the incoming air with the heated lower heat exchanger assembly 574. A heat exchanger with the configuration described with respect to heat exchanger 511 can provide various operational benefits described in greater detail below.

In various embodiments, other heat exchanger configurations are possible. For example, a heat exchanger such as heat exchanger 511 can further comprise features such as a baffle or other internal structure configured to direct incoming air within the heat exchanger in a manner suitable to extend the airflow path and/or surface area within the heat exchanger, thereby increasing thermal energy transfer from the firebox and heat exchanger to heat exchanger air volume 512.

In various embodiments, heat exchanger outlets 520 may vent air from heat exchanger 511 into a cavity or chase enclosure above fireplace system 500, or a fireplace system can further comprise an outlet duct coupled to heat exchanger 511 and in fluid communication with heat exchanger air volume 512 via heat exchanger outlet 520. In various embodiments and as described above with reference to FIG. 3, an outlet duct may be configured to channel heated air to a remote, external location.

In operation, heat exchanger 511 and various aspects of its configuration, such as the cowl opening configuration, heat exchanger outlet configuration, and the convection airflow pathway through the heat exchanger can reduce the build-up of heat in the firebox. This can in turn produce benefits such as reduced temperatures for various components of the fireplace system as well as for the cavity above the fireplace system and the building structure around the fireplace system. For example, the various features of fireplace system 500 may provide reduced temperatures for front panel 591 of the fireplace system and/or adjacent building materials in the surrounding building structure, enabling the use of combustible structural and finishing material. This reduced temperature effect has the advantage of providing more finishing options for the interior designer/homeowner, which is a desirable advantage in the market. Various features of a fireplace system such as fireplace system 500 may likewise reduce an operating temperature of a safety barrier, facilitating use of a more streamlined, aesthetically pleasing fireplace opening with greater visibility of the fire in the combustion chamber while maintaining a safe operating temperature of the safety barrier. Moreover, a heat exchanger such as heat exchanger 511 can provide various benefits described herein by facilitating natural convection-based cooling of the fireplace system without the need for an electromechanical forced convection system.

In accordance with various embodiments of the present disclosure, a method of reducing an operating temperature of a fireplace system and/or reducing heat transmission from a firebox to a space above a fireplace is also provided. A method can comprise the steps of: providing a firebox with a heat exchanger enclosure, transferring thermal energy from the firebox to a convection space air volume in the heat exchanger, venting the convection space air volume through an outlet to produce a bulk airflow through the heat exchanger, directing airflow from a first external location into an inlet, and directing vented airflow from the heat exchanger to a second external location.

Figure 6:
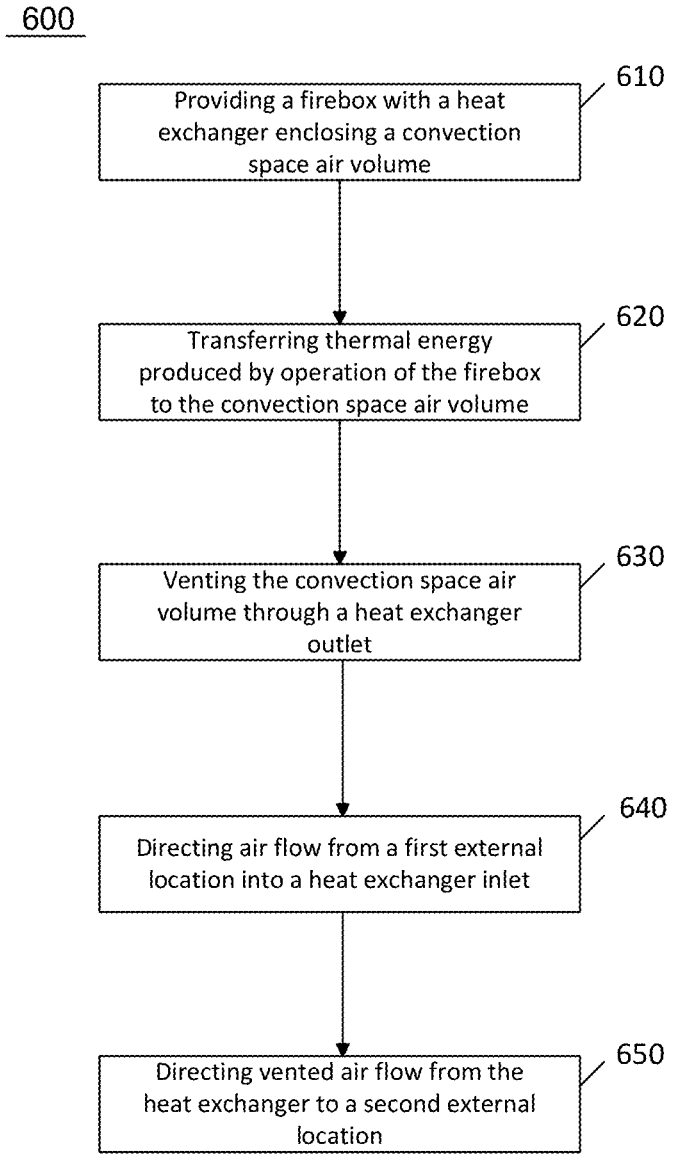
FIG. 6 illustrates a process flow for a method of reducing heat transmission from a firebox in accordance with various embodiments of the present disclosure.

Referring now to FIG. 6, a process flow for a method 600 is illustrated. Method 600 can comprise providing a firebox with a heat exchanger (step 610). The firebox can enclose a combustion chamber. Providing a firebox with a heat exchanger can comprise configuring a firebox with a heat exchanger in accordance with the embodiments described above, with the heat exchanger enclosing a convection space air volume such as heat exchanger air volume 112 described above with reference to FIG. 1 and further comprising an inlet, an outlet, a baffle, and a distal monitoring location.

In various embodiments, method 600 can further comprise transferring thermal energy to the convection space air volume (step 620). Thermal energy produced by operation of the fireplace system may be transferred to the convection space air volume by thermal conduction and/or radiant thermal energy transfer to produce a decrease in density of the convection space air volume relative to an external air volume. The relative decrease in air density of the convection space air volume produces an increased buoyancy of the convection space air relative to the external air volume. The relatively buoyant convection space air volume can drive a natural convective airflow through the convection air space of a fireplace system, as explained in greater detail below.

In various embodiments, method 600 can further comprise venting the convection space air volume through an outlet to an external location (step 630). Venting the convection space air volume can produce bulk airflow of the convection space air volume toward the external location. Fluid communication of the convection space air volume and an external air volume at an external location can produce bulk airflow between the heat exchanger of the fireplace system and the external air volume due to the natural convection forces produced by heating the convection space air volume during operation of a fireplace system.

In accordance with various embodiments, bulk airflow through the convection air space of a fireplace system need not be produced using a fan, blower, or other electromechanical means for producing forced convection, though in some embodiments, use of a forced convection system to provide bulk airflow through the convection air space is not prohibited and may contribute to some portion of the bulk airflow during operation of a fireplace system.

Method 600 can further comprise directing airflow from a first external location into the heat exchanger inlet (step 640). In various embodiments, a fireplace system such as fireplace system 100 illustrated in FIG. 1 can comprise an inlet such as inlet 121 having a configuration suitable to supply a sufficient flow rate of air to maintain the bulk airflow produced in step 630. In various embodiments, directing airflow from a first external location into the inlet can comprise configuring various properties of a fireplace system to maintain a desired airflow rate. Moreover, a desired airflow rate may be dependent on safety considerations relative to the operating temperature of the firebox or of the cavity above the fireplace system. Thus, the dimensions or configuration of an inlet aperture, heat exchanger baffle, or other aspects of a heat exchanger may be changed based on the configuration, operating parameters, safety parameters, and/or location of a fireplace system.

In various embodiments, method 600 can further comprise directing vented airflow from the heat exchanger outlet to a second external location (step 650). A second external location can include, for example, the room in which the fireplace is located or a cavity above the fireplace system. In various embodiments, the operating temperature of the firebox and/or the heat exchanger during fireplace operation may be maintained below a maximum operating temperature during operation of a fireplace system (such as fireplace system 100 (FIG. 1)) comprising a natural convection cooling system operating in accordance with method 600. While not wishing to be limited by theory, bulk airflow through the heat exchanger may facilitate maintaining the operating temperature of the fireplace system below a maximum operating temperature. A maximum operating temperature may be determined relative to any specific location within the fireplace system, such as an outer surface of a safety barrier, a location on a surface of the firebox shell, a location on a surface of the heat exchanger, a location in the cavity above the fireplace system, or the like.

In various embodiments, a heat exchanger of a fireplace system can comprise a distal monitoring location at which an operating temperature of the fireplace system may be determined. For example, a distal monitoring location may comprise a location on the outer surface of an upper wall of the heat exchanger. An operating temperature of the fireplace system may be determined at the distal monitoring location at various time intervals during operation of the fireplace system or to compare the operating temperature of the fireplace system during operation under different conditions. For example, a first operating temperature may be determined at the distal monitoring location for a fireplace system comprising a heat exchanger in accordance with various embodiments in a condition in which bulk airflow through the heat exchanger is disabled (e.g., by blocking the outlet). A second operating temperature may be determined at the distal monitoring location during operation under identical conditions, with the exception that bulk airflow through the heat exchanger is enabled. Bulk airflow through the heat exchanger may reduce the operating temperature of the fireplace system at the distal monitoring location. For example, the second operating temperature may be about 5° F. to about 150° F., or about 10° F. to about 125° F., or about 15° F. to about 100° F., or about 20° F. to about 75° F., or about 25° F. to about 60° F., or about 30° F. to about 45° F. less than the first operating temperature. The difference in temperature may be dependent on the location of the distal monitoring location.

Testing of a prototype fireplace system configured in accordance with fireplace system 500 illustrated in FIGS. 5A-5H (with the exception that it comprised two safety barriers rather than three safety barriers) produced temperature decreases between the first and second operating temperatures at distal monitoring locations within the fireplace system, including a temperature decrease of about 28° F. at front panel 591, a decrease of about 109° F. at a collar securing combustion gas exhaust channel 523 to lower heat exchanger assembly 574, and a decrease of about 5° F. at an outer surface of second safety barrier 506. Likewise, temperature decreases were produced for distal monitoring locations outside of the fireplace system, such as a temperature decrease of about 21° F. at a header positioned above and adjacent to the top front edge of the fireplace system. Distal monitoring locations both within and outside of the system can comprise specified locations subject to temperature restrictions in accordance with safety regulations. These results demonstrate that a heat exchanger convection cooling system and method in accordance with various embodiments described herein is effective to provide substantial cooling of a fireplace system and/or can provide sufficient decreases in the operating temperature of distal monitoring locations to achieve compliance with safety regulations. As described above, the bulk airflow that facilitates system cooling may be produced by the heat exchanger without the need for an electromechanical blower or fan, though nothing in the present disclosure should be interpreted to prohibit inclusion of such components in a system in accordance with various embodiments.

The present disclosure sets forth a system and method for providing a fireplace system with a heat exchanger that is cooled by natural convection using inconspicuously located inlets and remotely located outlets. It will be understood that the foregoing description is of exemplary embodiments of the disclosure, and that the disclosure is not limited to the specific configurations shown. Various modifications may be made in the design and arrangement of the elements of the systems and methods set forth herein without departing from the scope of the disclosure. For example, the configuration and arrangements of various components of a fireplace system may deviate from those of the exemplary embodiments described and illustrated herein while achieving a similar functional and/or aesthetic purpose. These and other changes or modifications are intended to be included within the scope of the present disclosure.

What is claimed is:

1. A fireplace system comprising:

a firebox enclosing a combustion chamber; and a heat exchanger comprising:

an enclosure defining a heat exchanger air volume;

a heat exchanger inlet disposed in the enclosure and in fluid communication with an external air source and the heat exchanger air volume; and a heat exchanger outlet disposed in the enclosure and in fluid communication with the heat exchanger air volume, wherein the heat exchanger inlet and the heat exchanger outlet are disposed above a fireplace viewing area of the firebox, and wherein the heat exchanger facilitates airflow through the enclosure by natural convection.

2. The fireplace system of claim 1, wherein the combustion chamber is fluidly isolated from the heat exchanger air volume.

3. The fireplace system of claim 1, wherein at least a portion of an upper wall of the firebox comprises at least a portion of a lower wall of the heat exchanger.

4. The fireplace system of claim 1, wherein the heat exchanger inlet is disposed proximate a top-front of the firebox.

5. The fireplace system of claim 1, further comprising a combustion air inlet disposed through a rear of the fireplace system and in fluid communication with the combustion chamber.

6. The fireplace system of claim 5, further comprising a firebox exhaust system comprising an exhaust flue that is coaxial with the combustion air inlet.

7. The fireplace system of claim 1, further comprising a cowl disposed about the heat exchanger inlet.

8. The fireplace system of claim 1, wherein the heat exchanger further comprises a pressure relief door.

9. A method, comprising:

transferring thermal energy produced by operation of a firebox to a convection space air volume in a heat exchanger enclosure of a heat exchanger, wherein the firebox and the heat exchanger enclosure are coupled together and fluidly separate, wherein the heat exchanger enclosure comprises an inlet and an outlet, wherein the transferring thermal energy produces a decrease in an air density of the convection space air volume, and wherein the decrease in the air density produces an increased air buoyancy of the convection space air volume relative to an external air volume;

venting the convection space air volume through the outlet, wherein the venting produces a bulk airflow through the heat exchanger;

directing airflow from a first external location into the inlet of the heat exchanger enclosure;

directing vented airflow from the outlet of the heat exchanger to a second external location; and at a distal monitoring location on or in the heat exchanger, producing a temperature difference between a first operating temperature and a second operating temperature, wherein the first operating temperature is produced in response to the venting being disabled, wherein the second operating temperature is produced in response to the venting being enabled, and wherein the temperature difference between the first operating temperature and the second operating temperature is more than about 100° F., and wherein the venting the convection space air volume through the outlet, the bulk airflow, the directing airflow from the first external location into the inlet, and the directing vented airflow from the outlet to the second external location occur without use of a fan or blower.

10. The method of claim 9, wherein the heat exchanger enclosure further comprises a baffle disposed therein configured to partition the heat exchanger enclosure into a first portion adjacent to a lower wall of the heat exchanger enclosure and a second portion adjacent to an upper wall of the heat exchanger enclosure, wherein the first portion and the second portion are in fluid communication, and wherein the method further comprises:

directing the convection space air volume through the first portion and the second portion of the heat exchanger enclosure via the baffle.

11. The method of claim 9, wherein the inlet and the outlet of the heat exchanger enclosure are disposed proximate a top of the firebox.

12. The method of claim 9, further comprising directing exhaust from a combustion chamber of the firebox through an exhaust gas channel, wherein the exhaust gas channel is disposed through the heat exchanger enclosure, and wherein the heat exchanger enclosure and the exhaust gas channel are fluidly separate.

13. The method of claim 9, wherein the convection space air volume is above the firebox.

14. The fireplace system of claim 1, wherein the heat exchanger air volume is above the firebox.

15. A fireplace system comprising:

a firebox enclosing a combustion chamber; and a heat exchanger comprising:

an enclosure defining a heat exchanger air volume, wherein the heat exchanger air volume is above the firebox;

a heat exchanger inlet disposed in the enclosure and in fluid communication with an external air source and the heat exchanger air volume; and a heat exchanger outlet disposed in the enclosure and in fluid communication with the heat exchanger air volume, wherein the heat exchanger facilitates airflow through the enclosure by natural convection.

* * * * *